United States Patent [19]

Ehlen

[11] 4,018,236

[45] Apr. 19, 1977

[54] ASH TRAY

[76] Inventor: Albert E. Ehlen, 539 Linwood Ave., Buffalo, N.Y. 14209

[22] Filed: Mar. 17, 1976

[21] Appl. No.: 667,635

[52] U.S. Cl. ..... 131/240 R

[51] Int. Cl.[2] ..... A24F 15/08; A24F 19/00

[58] Field of Search ..... 131/235 R, 238, 240 R, 131/241; D27/8, 14, 15, 27

[56] References Cited

UNITED STATES PATENTS

| | | | |
|---|---|---|---|
| 2,184,994 | 12/1939 | Dyke | 131/235 R |
| 2,275,099 | 3/1942 | Aubuchon | 131/235 R |
| 2,318,149 | 5/1943 | Ferman | 131/235 R |
| 2,337,409 | 12/1943 | Penn | 131/238 X |

FOREIGN PATENTS OR APPLICATIONS

| | | | |
|---|---|---|---|
| 804,379 | 4/1951 | Germany | 128/240 |

*Primary Examiner*—Stephen C. Pellegrino
*Attorney, Agent, or Firm*—Bean & Bean

[57] ABSTRACT

An ash tray is characterized as having an upwardly opening ash receiver receiving chamber circumscribed by a rim shaped to define a slot sized and arranged to removably, frictionally grip a butt end of a cigarette and to position such cigarette to upstand from within the slot with its ash and arranged to overlie the chamber.

12 Claims, 4 Drawing Figures

ASH TRAY

BACKGROUND OF THE INVENTION

Over the years many attempts have been made to devise a simply constructed and readily cleansed ash tray, which would provide a safety/fire protection feature, while at the same time permitting a supported cigarette to burn uniformly without becoming wet or contaminated with ashes.

Prior patents, which have been brought to my attention as being illustrative of those directed towards ash trays providing one or more of these features include U.S. Pat. Nos. D-203,237; 1,727,582; 2,221,300; 2,264,473; 2,275,099; 2,318,149; 2,337,409; 2,844,153; 2,910,986 and 3,675,662.

The ash trays disclosed by the above enumerated prior U.S. patents are of such diverse construction as to defy generalization other than to note that none appear to provide all of the features named as being desirable in an ash tray.

SUMMARY OF THE INVENTION

The present invention is directed towards an ash tray, which is characterized as being of a simple construction and as being adapted to positively prevent a burning cigarette from dropping from the tray onto a table or the like. Moreover, the present invention is directed towards a novel ash tray construction, which may be readily cleaned and which serves to prevent "wetting" of a supported cigarette, during the burning thereof, and to hold a burning cigarette such that its ashes will be collected in a relatively remote ash receiving chamber in order to prevent ash contamination of such cigarette.

More specifically, the ash tray formed in accordance with the present invention is characterized in that it is formed with a rim having one or more portions shaped to define a slot, which is sized and arranged to frictionally grip a butt end of a cigarette, such that the cigarette vertically upstands from within the slot with its ash end disposed above an upwardly opening ash receiving chamber bounded by the rim.

In accordance with a preferred form of the present invention, the ash tray is of integral construction in order to facilitate manufacture thereof and provided with an endless cigarette gripping slot, which circumscribes the ash receiving chamber in order to provide for random insertion of cigarettes thereinto and to maximize the number of cigarettes which can be supported at any given time. However, alternate constructions are disclosed, which do not depart from the spirit of the present invention.

DETAILED DESCRIPTION

Figure 1:
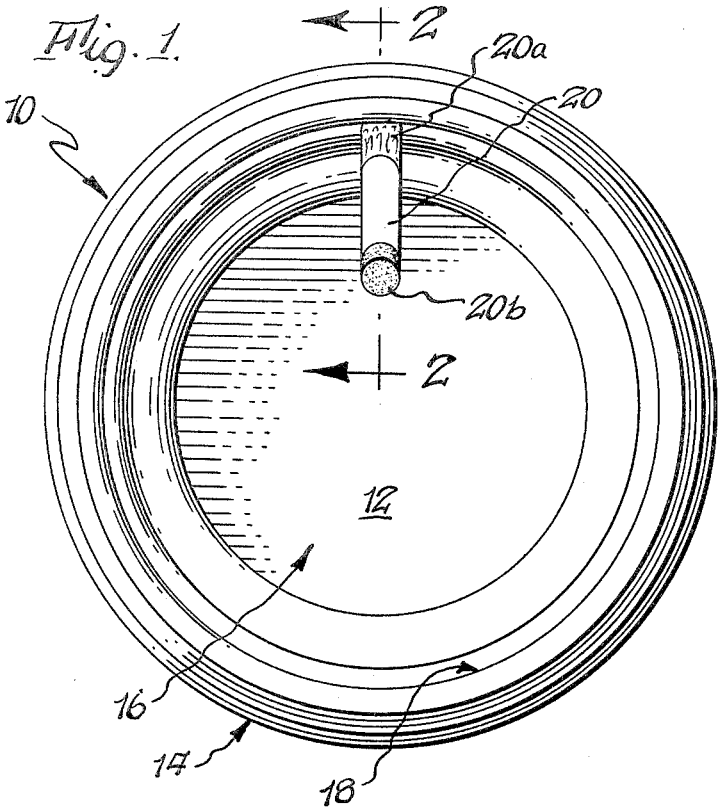
Figure 2:
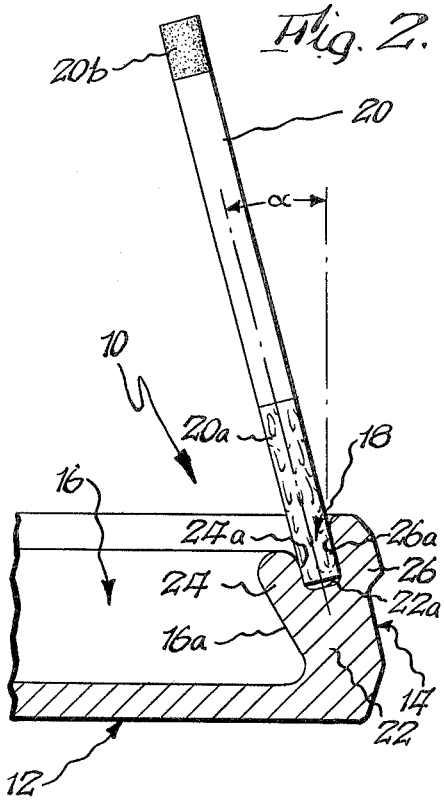

An improved ash tray formed in accordance with the preferred form of the present invention is designated as 10 and shown in FIGS. 1 and 2 as comprising a base wall 12 and a rim 14, which is preferably formed integrally with the periphery of the base wall.

It will be understood that base wall 12 and rim 14 cooperate to define an upwardly opening ash receiving chamber 16, whereas rim 14 serves to define an upwardly opening endless shallow slot 18, which circumscribes the chamber and serves to provide an improved support for one or more cigarettes 20. For purposes of reference, cigarette 20 is considered as being characterized as including a butt or filter end portion 20*a* and an ash or consumable end portion 20*b*.

More specifically, rim 14 is shown in FIG. 2 as being of a generally "Y" shaped configuration and as including a base portion 22, which is joined to the periphery of and upstands vertically above base wall 12, and concentrically arranged relatively inner and outer leg or rim portions 24 and 26, respectively, which are joined to and upstand vertically above base portion 22. As will be apparent from viewing FIG. 2, base portion 22 and inner leg 24 cooperate to define a vertical boundary wall surface 16a of chamber 16, whereas base portion wall surface 22*a* and facing leg portion wall surfaces 24*a* and 26*a* cooperate to bound slot 18.

In accordance with the present invention, the width of slot 18 is such as to permit facing surfaces 24*a* and 26*a* to removably, frictionally grip cigarette butt end 20*a* to an extent sufficient to support cigarette 20 to vertically upstand from within the slot. However, the spacing or distance between facing surfaces 24*a* and 26 should be in excess of that which would lead to excessive deformation of cigarette butt end 20*a* and/or cause the cigarette to collapse or pull apart, while being inserted or removed from the slot. Further, the present invention contemplates that slot 18 should be inclined through an angle $\alpha$ relative to the vertical and arranged to extend upwardly and inwardly relative to chamber 16 in the manner best shown in FIG. 2. The exact value of angle $\alpha$ is a matter of choice, but should be sufficiently large to insure that the ash end 20*b* of a cigarette supported within slot 18 is arranged to overlie chamber 16 and fall thereinto under the influence of gravity, as the cigarette is progressively consumed. On the other hand, for any given ash tray construction, angle $\alpha$ should not exceed that value which would result in engagement of the ash ends of cigarettes supported on opposite sides of the ash tray and/or which would result in the ash end of a cigarette supported on one side of an ash tray being positioned without the boundaries of chamber 16 on an opposite side of such ash tray. When ash tray 10 is intended for use with cigarettes having a filter tip, an angle equal to or exceeding approximately 15° would be sufficient to insure that the cigarette would be supported such as to insure that all ash would fall into chamber 16 and thus maintain slot 18 in a clean condition. If cigarettes of the non-filter variety were supported in slot 18, the proximity of surfaces 24*a* and 26*a* would normally serve to "snuff-out" butt end 20*a* before entirely consumed and thereby minimize collection of ash and/or "wetness" in the slot.

For any given construction, the depth of slot 18, as measured between the upper end of one or the other or both of legs 24 and 26 and bottom surface 22*a*, would be sufficient to provide for proper frictional gripping of butt end 20*a* by surfaces 24*a* and 26*a* without rendering bottom surface 22*a* inaccessible for cleaning purposes. Preferably, bottom surface 22*a* would be rounded, as shown in FIG. 2, in order to facilitate cleaning and prevent engagement of the end surface of cigarette butt end 20*a* with the bottom surface, which may remain damp for a short period after cleaning if not properly dried and which may become covered with ashes due to improper use of the ash tray.

By again referring to FIG. 2, it will be seen that the upper end of inner leg 24 is preferably arranged vertically below the upper end of outer leg 26 in order to facilitate access to slot 18 for cleaning purposes, and to cause gravity feed of a cigarette downwardly into chamber 16 in the event that a smoker, who is unfamiliar with the purpose of slot 18, should attempt to support his cigarette on rim portion 14.

The endless slot design of ash tray 10 described above with reference to FIGS. 1 and 2 is preferred in that it permits random placement of cigarettes about the periphery of chamber 16, and facilitates cleaning of slot 18, due to the fact that there are no slot ends or pockets in which dirt or other foreign material may accummulate. Further, from an aesthetic point of view, the circular plan view configuration of ash tray 10 depicted in FIG. 1 is preferred. However, it is anticipated that the circular form of ash tray 10 may be varied to assume for instance an oval or kidney shape, without departing from the present invention.

Figure 3:
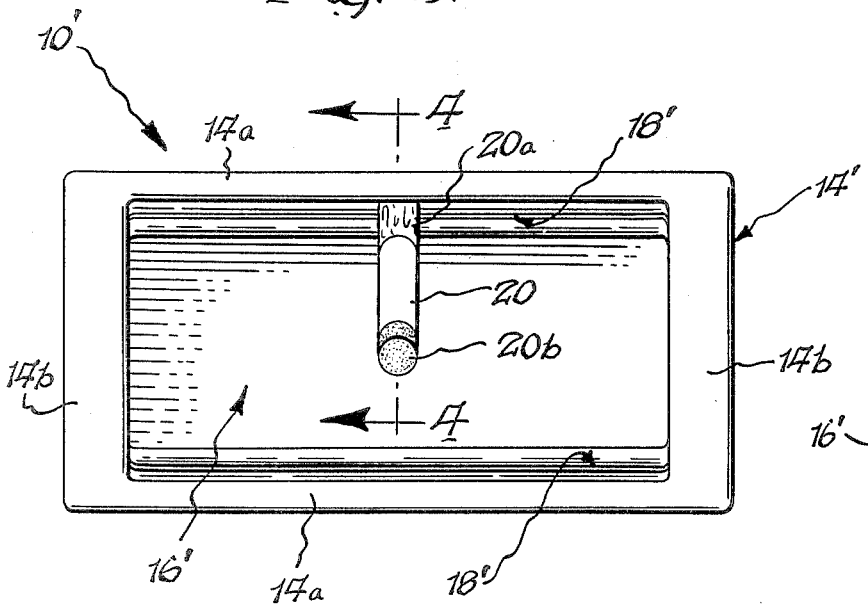
Figure 4:
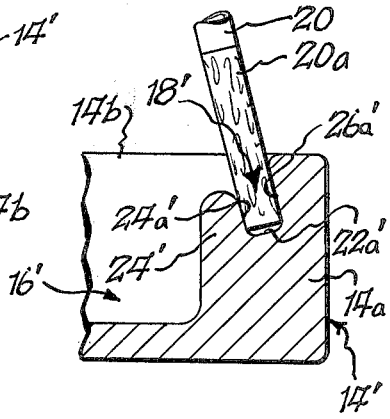

Reference is now made to FIGS. 3 and 4 as by way of illustrating an alternative ash tray construction designated as 10', wherein rim 14' includes a plurality of cigarette supporting portions **14*a*, which serve to define cigarette supporting slots 18', and end portions 14*b*, which serve to end connect supporting portions 14*a*. While ash tray 10' is shown as being of rectangular plan view configuration, wherein supporting portions 14*a* are parallel and have their associated slots 18' arranged to open in a facing relationship, it will be understood that supporting and non-supporting portions 14*a* and 14*b* may be arcuate, such that ash tray 10' assumes a circular plan view configuration similar to that illustrated in FIG. 1. It will be understood that when a discontinuous slot arrangement of the type illustrated in FIG. 3 is employed, it is necessary to have the length of each of slots 18', as measured in a direction circumscribing chamber 16', exceed the width of such slots, as measured between surfaces 24*a'* and 26*a'*** and preferably by at least several cigarette diameters in order to facilitate friction fitting of the cigarette thereinto and to permit cleaning of the slots without resorting to special tools.

As a practical matter, the cleaning of ash trays employing discontinuous slots may be facilitated, such as by cutting away inner leg 24' adjacent rim portions 14b in order to provide such slots with "open ends" or by progressively decreasing the size of such slots adjacent their ends by upwardly curving bottom wall **22*a'*. In either case, the presence of "blind pockets" adjacent the ends of slots 18'** would be eliminated.

I claim:

1. In an ash tray having an upwardly opening ash receiving chamber circumscribed by a rim, said rim having at least one support portion adapted to support a cigarette when not being held by a smoker, the improvement wherein said support portion defines a slot inclined upwardly and inwardly towards said chamber, said slot including a pair of facing side wall surfaces disposed respectively relatively adjacent to and remote from said chamber, said side wall surfaces being spaced to frictionally receive therebetween a butt end of said cigarette whereby to position said cigarette to upstand from within said slot with an ash end thereof arranged to overlie said chamber, and said slot having a length as measured in a direction circumscribing said chamber in excess of the distance between said side wall surfaces.

2. An ash tray according to claim 1, wherein said support portion and said slot are endless and peripherally bound said chamber.

3. An ash tray according to claim 2, wherein said chamber, said support portion and said slot are of circular plan view configuration.

4. An ash tray according to claim 1, wherein said rim has at least two support portions and the slots defined thereby are spaced apart in a direction circumscribing said chamber.

5. An ash tray according to claim 1, wherein said support portion is of essentially Y-shaped cross-sectional configuration defined by a vertically upstanding base portion and inner and outer rim portions joined to and upstanding above said base portion, said inner and outer rim portions defining said side wall surfaces of said slot, said base portion defining a bottom wall surface of said slot, and said inner rim portion and said base portion defining a vertically extending boundary wall surface of said chamber adjacent said support portion.

6. An ash tray according to claim 5, wherein said outer rim portion upstands vertically above said inner rim portion.

7. An ash tray according to claim 6, wherein said slot is an endless slot peripherally bounding said chamber.

8. An ash tray according to claim 7, wherein said chamber, said support portion and said slot are of circular plan view configuration.

9. An ash tray according to claim 5, wherein said rim has at least two support portions, and the slots defined thereby are spaced apart in a direction circumscribing said chamber.

10. An ash tray according to claim 9, wherein said rim is of rectangular plan form configuration and said support portions and the slots defined thereby are arranged in a spaced parallel relationship.

11. An ash tray comprising in combination: a base wall and a rim formed integrally with the periphery of said base wall, said rim having a base portion joined to and extending vertically above said periphery of said base wall and a pair of leg portions joined to and extending vertically above said base portion, said base portion and a relatively innermost one of said leg portions cooperating with said base wall to define an upwardly opening ash receiving chamber, said leg portions having facing surfaces cooperating to bound an endless slot extending peripherally of said chamber, said slot having a widthwise dimension as measured between said facing surfaces for frictionally supporting a butt end of a cigarette inserted therewithin and being inclined in a direction extending upwardly and inwardly relative to said chamber for positioning an ash end of said cigarette to overlie said chamber.

12. An ash tray according to claim 11, wherein a relatively outermost of said leg portions extends vertically above said innermost leg portion, and said chamber, said rim and said slot are of circular plan view configuration.

* * * * *